US006933823B2

(12) United States Patent
Chen

(10) Patent No.: US 6,933,823 B2
(45) Date of Patent: Aug. 23, 2005

(54) METHOD OF INSTALLING TRANSFORMER WINDING COILS AND THE TRANSFORMER STRUCTURE FORMED USING SUCH METHOD

(75) Inventor: Chi-Sheng Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 125 days.

(21) Appl. No.: 10/691,648

(22) Filed: Oct. 24, 2003

(65) Prior Publication Data

US 2004/0252000 A1 Dec. 16, 2004

(30) Foreign Application Priority Data

Jun. 13, 2003 (TW) ..... 92116198 A

(51) Int. Cl.[7] ..... H01F 27/29

(52) U.S. Cl. ..... 336/192; 336/208; 336/90; 29/602.1

(58) Field of Search ..... 336/192, 208, 336/65, 90, 200, 212; 29/602.1, 606

(56) References Cited

U.S. PATENT DOCUMENTS 4,509,032 A * 4/1985 Post ..... 336/59
4,636,752 A * 1/1987 Saito ..... 333/12
4,937,546 A * 6/1990 Horng ..... 336/65
5,684,446 A * 11/1997 Adkins et al. ..... 336/92
6,808,669 B2 * 10/2004 Kim ..... 264/272.19

* cited by examiner

*Primary Examiner*—Anh Mai
(74) *Attorney, Agent, or Firm*—Bacon & Thomas PLLC

(57) ABSTRACT

The present invention is directed to a method of installing transformer winding coils, including the steps of: providing a transforming including a magnetic core assembly, a primary winding coil, a secondary winding coil, a winding frame, and an enclosure, wherein the primary winding coil and the secondary winding coil are respectively wounded around the winding frame; wrapping the portions of the winding coils wounded around the winding frame with a tape and leading out a plurality of winding outlets from the winding frame; positioning the magnetic core assembly and the winding frame fixedly within the enclosure; and directly securing the winding outlets to a printed circuit board such that the transformer can be electrically connected to the printed circuit board.

11 Claims, 9 Drawing Sheets

METHOD OF INSTALLING TRANSFORMER WINDING COILS AND THE TRANSFORMER STRUCTURE FORMED USING SUCH METHOD

FIELD OF THE INVENTION

The present invention is related to a method of installing transformer winding coils and the transformer structure formed using such method, and more particularly to a method of installing transformer winding coils by directly leading out winding outlets from a winding frame and the transformer structure formed using such method.

BACKGROUND OF THE INVENTION

A transformer has become a must-have circuit element for various kinds of electric appliance. Referring to FIG. 1, a conventional transformer principally comprises a magnetic core assembly 1, a winding frame 2, a primary winding coil (not shown), a secondary winding coil (not shown), and an enclosure. The primary winding coil and the secondary winding coil are wounded around the winding frame 2 and interact with the magnetic core assembly 1 to achieve the object of voltage regulation. The magnetic core assembly 1 is generally shaped as an EI-type core or an EE-type core. The enclosure 3 is made up of a bottom plate assembly 31 and a seal plate 32. When the bottom plate assembly 31 and the seal plate 32 are assembled, the magnetic core assembly 1 and the winding frame 2 can be fixedly positioned within the inner space enclosed by the bottom plate assembly 31 and the seal plate 32, and thereby construct the body of a transformer.

Referring to FIG. 1 again, the winding outlets of the primary winding coil and secondary winding coil that are wounded around the winding frame 2 are soldered together with a plurality of copper wirings 21, 22, 23 that are wrapped by polyvinyl chloride (PVC) film. Each of the free ends of the copper wirings 21, 22, 23 is provided with a stationary terminal, and each of the stationary terminals is used to secure the copper wirings 21, 22, 23 to the through holes on a print circuit board (not shown), thereby an electric connection can be established between the transformer and the printed circuit board. Alternatively, the transformer can be secured to the housing of an electric appliance or a printed circuit board depending on the requirements of circuit design.

The assembling process of a conventional transformer is described as follows: As shown in FIG. 2(*a*), the primary winding coil (not shown) and the secondary winding coil (not shown) are wounded around the winding frame 2, wherein the material of the primary winding coil and the secondary winding coil is preferably selected from copper wires. Next, the portions of the transformer windings wounded around the winding frame 2 are wrapped by a tape 24. Meanwhile, four winding outlets 25, 26, 27, 28 of the transformer windings will be led out from the winding frame 2. Next, as shown in FIG. 2(*b*), the first winding outlet 25 is soldered together with a first copper wiring 21 wrapped by a PVC film, the second winding outlet 26 is soldered together with a second copper wiring 22 wrapped by a PVC film, and the third winding outlet 27 and fourth winding outlet 28 are soldered together with a third copper wiring 23 wrapped by a PVC film, wherein the third and the fourth winding outlet 27 and 28 can be respectively led out from the primary winding coil and the secondary winding coil.

In order to prevent the bare portions of the three copper wirings from contacting with each other and prevent each solder point from piercing the insulating PVC film and causing the transformer to become short-circuited and finally burn out, the bare portions of the copper wirings are isolated from each solder point by tapes and pads according to prior art, and then the first winding outlet 25 and the first copper wiring 21 are folded upward and wrapped with one or several tapes 291 or a pad 292 so as to cover the bare portions of the copper wirings and solder points. Next, the second winding outlet 26 and the second copper wiring 22 are folded upward and wrapped with one or several tapes 293 or a pad 294 so as to cover the bare portions of the copper wirings and solder points. Finally, the third winding outlet 27 and the fourth winding outlet 28 as well as the third copper wiring 23 are folded upward and wrapped with one or several tapes 295 or a pad 296. Next, the free ends of each copper wiring 21, 22, 23 are tied with stationary terminals, such that these copper wirings 21, 22, 23 are secured and electrically connected to the printed circuit board.

The rest assembling process of the transformer are described as follows. Referring to FIG. 1 again, the magnetic core assembly 1 and the winding frame 2 with transformer windings clung thereto are coupled together and fixedly fit into the bottom plate assembly 31. After the seal plate 32 is mechanically cooperated with the bottom plate assembly 31 to enclose the magnetic core assembly 1 and the winding frame 2 and the supporting pins are bent and fixed, the whole transformer is immersed into a petrolatum solution. After the baking process performed to the transformer is finished, the whole manufacturing process of transformer is completed.

Subsequently, the stationary terminals of the copper wirings 21, 22, 23 are inserted into the through holes (not shown) on the printed circuit board, in order that an electric connection can be established between the transformer and the printed circuit board.

However, it can be understood from the above statements that the conventional assembling process of transformer needs numerous tapes and pads, and the transformer formed thereby is quite complicated in structure and require a costly manufacturing budget. More disadvantageously, the operations of wrapping the tapes and pads need to be done iteratively, and thus these operation become difficult to handle and the manufacturing yield of transformer can not be promoted further. In addition, each of the winding outlets (copper wires) are needed to be soldered with a corresponding copper wiring, and quality of the transformer will be debased because of the problems that the solder points pierce the insulating film. What is worse, the insulating film of the copper wiring is made up of PVC having a comparatively low melting point (about 105° C.), so that the durability against temperature for the transformer will be limited. Furthermore, each of the free ends of the copper wirings can not be directly secured to the printed circuit board, and thus the stationary terminals and the operation of processing the stationary terminals are required. In view of the above disadvantages, the conventional assembling process of a transformer not only squanders many materials in manufacturing and disburse more cost on manufacturing process, but also complicates manufacturing steps and lowers manufacturing yield.

SUMMARY OF THE INVENTION

A major object of the present invention is to provide a method of installing the transformer windings, and a transformer made by such method can result in a reduced manufacturing cost and manufacturing time, and the manufacturing yield of transformer can be improved.

To this end, the method of installing the transformer winding according to the present invention includes the following steps of: providing a transformer, wherein the transformer includes a magnetic core assembly, a winding frame, a primary winding coil, a secondary winding coil, and an enclosure, and wherein the primary winding coil and the secondary winding coil are wounded around the winding frame. The portions of the winding coils wounded around the winding frame are wrapped by a tape and a plurality of winding outlets are led out from the winding frame. Next the magnetic core assembly and the winding frame are fixedly positioned within the enclosure and the plurality of winding outlets are secured to a printed circuit board, so that the transformer is electrically connected to the printed circuit board.

In accordance with the present invention, after the step of wrapping the tape on the portions of winding coils wounded around the winding frame and leading out a plurality of winding outlets from the winding frame is performed, the method further includes the a step of folding the winding outlets and sticking the winding outlet to the winding frame with another tape.

In accordance with the present invention, the magnetic core assembly is shaped as an EE-type core or an EI-type core.

In accordance with the present invention, the enclosure includes a bottom plate assembly and a seal plate. When the bottom plate assembly and the seal plate are assembled, the magnetic core assembly and the winding frame can be fixedly positioned within the inner space enclosed by the bottom plate assembly and the seal plate.

In accordance with the present invention, the transformer further includes an insulating film coated on the winding outlets for providing electrical insulation to the winding outlets.

In accordance with the present invention, the material of the primary winding coil and the secondary winding coil is selected from copper wires.

Now the foregoing and other features and advantages of the present invention will be best understood through the following descriptions with reference to the accompanying drawings, wherein:

DETAILED DESCRIPTION OF THE PREFERRED EMBODIMENT

Figure 1:
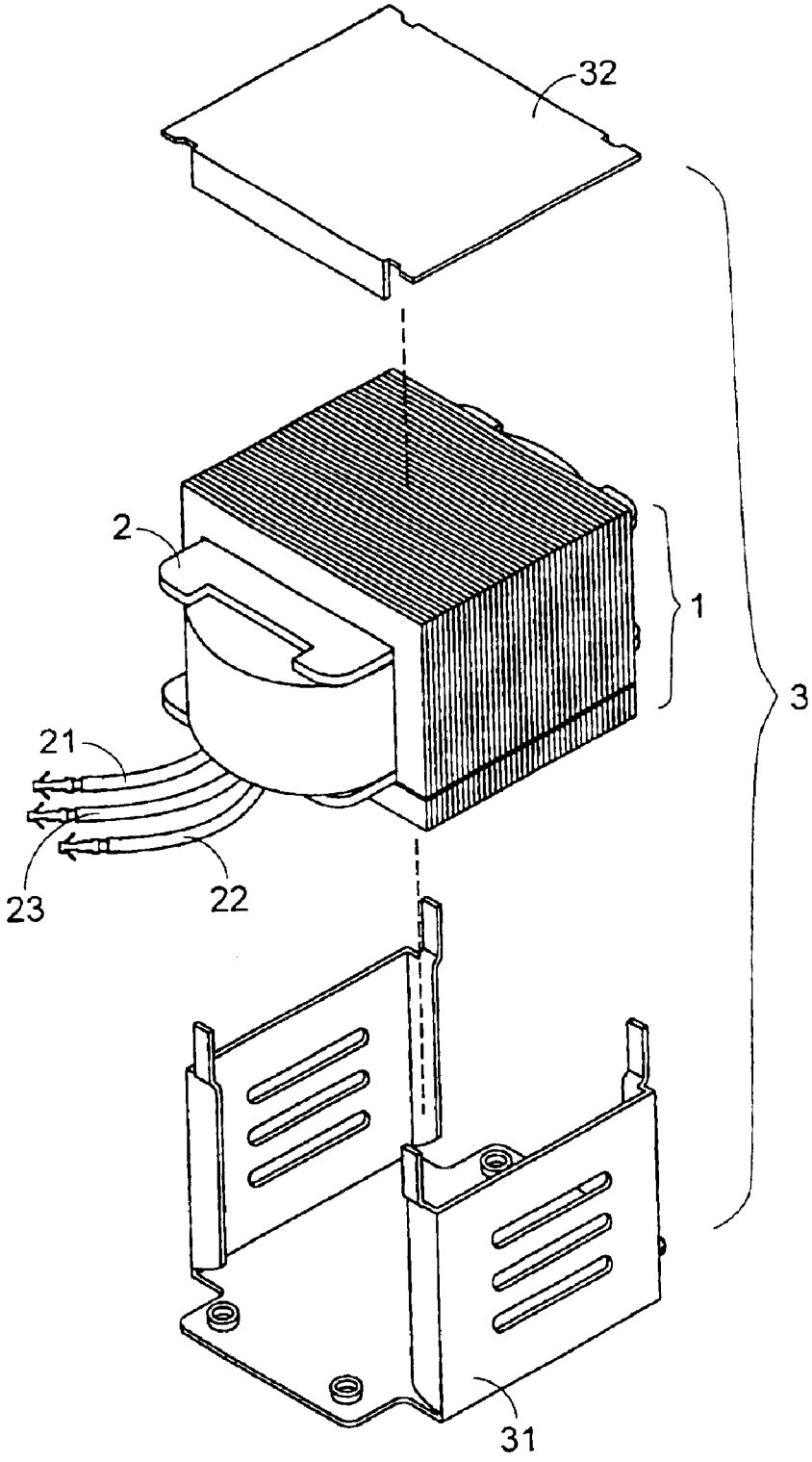
Fig.1 Prior Art
FIG. 1 is a diagram showing a conventional transformer structure.
Figure 2A:
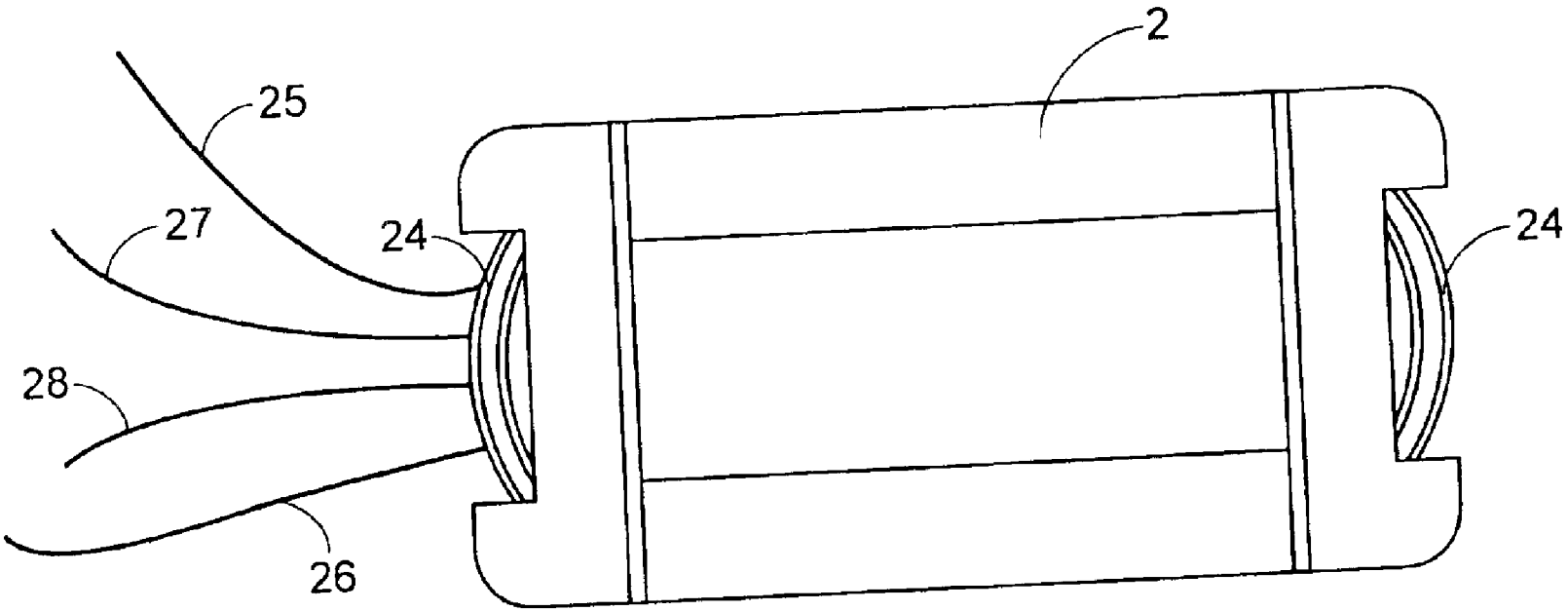
Fig.2(a) Prior Art
FIGS. 2(*a*)–2(*c*) are diagrams showing the steps of installing transformer winding coils and the assembling process of a transformer according to the prior art.
Figure 2B:
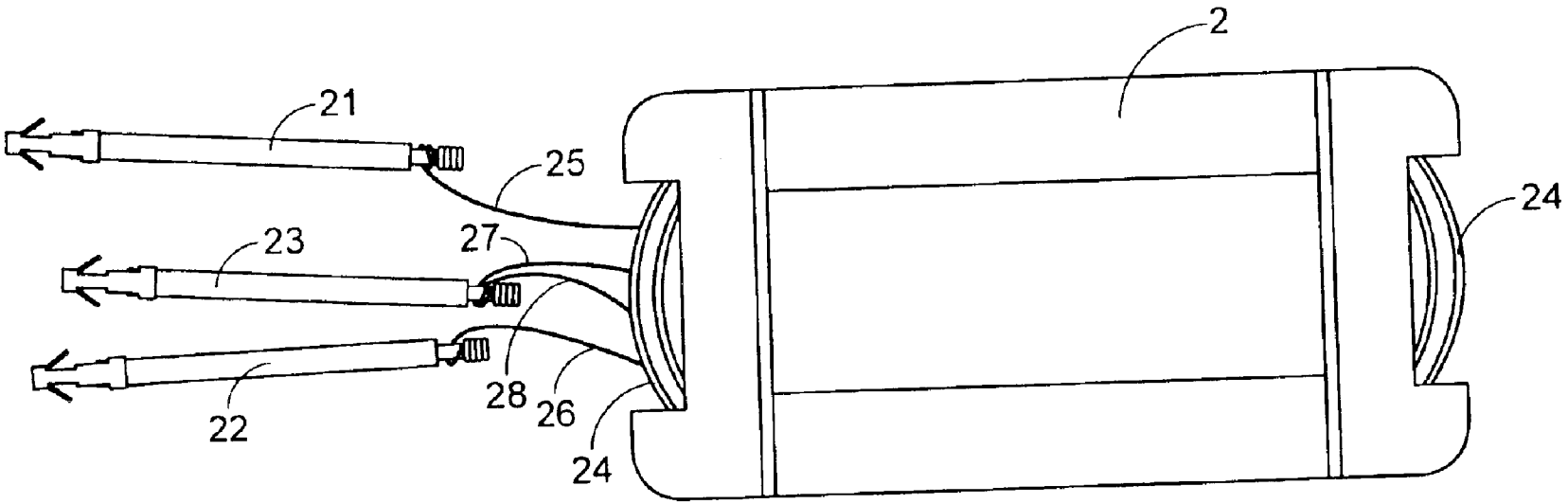
Fig.2(b) Prior Art
Figure 2C:
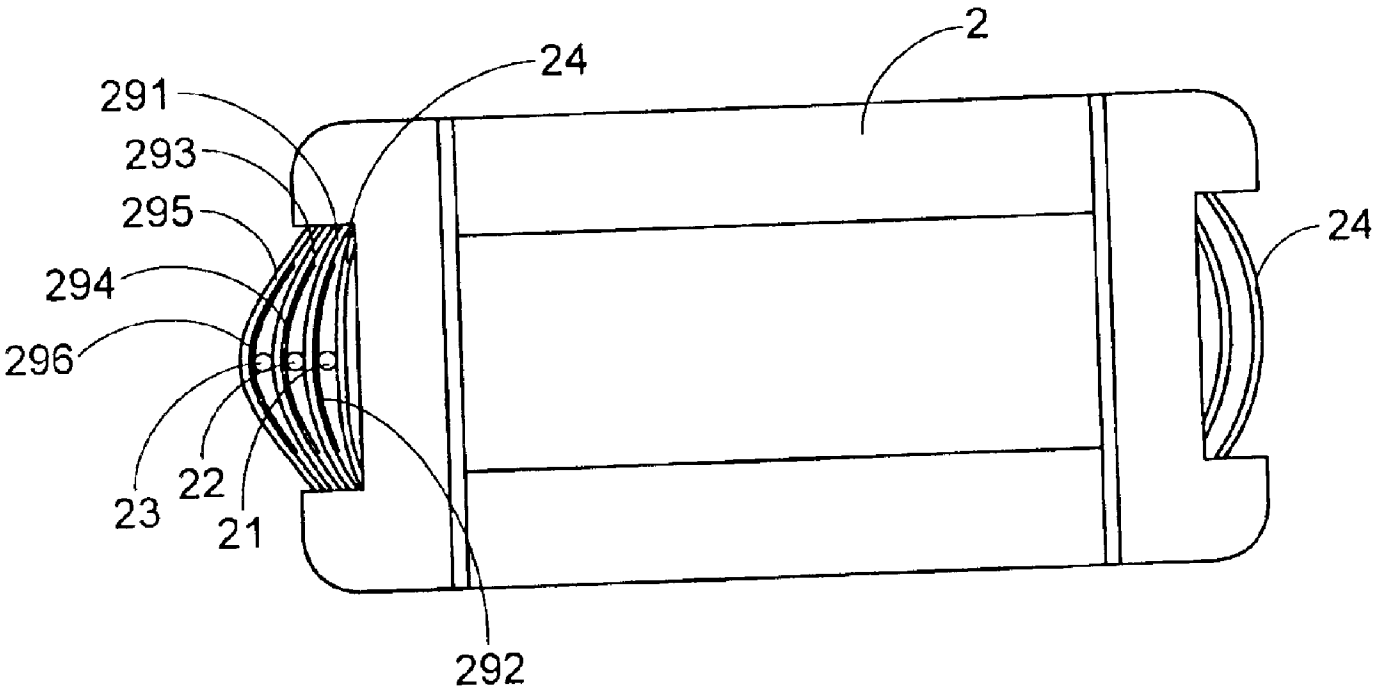
Fig.2(c) Prior Art
Figure 3:
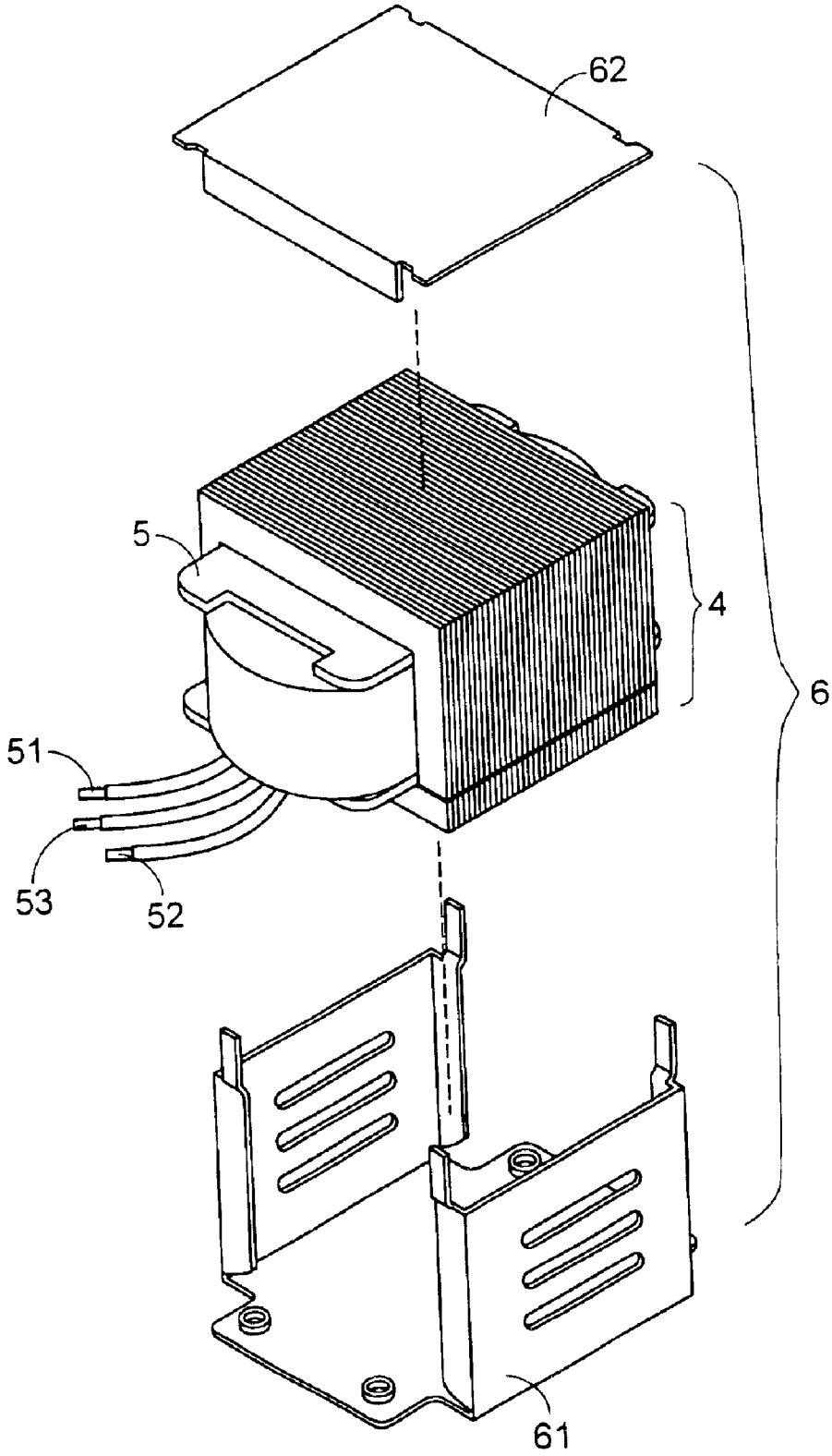
FIG. 3 is a diagram showing a transformer structure according to the present invention.

The transformer structure according to the present invention is illustrated in FIG. 3. As shown in FIG. 3, the transformer comprises a magnetic core assembly 4, a winding frame 5, a primary winding coil (not shown), a secondary winding coil (not shown), and an enclosure 6. The primary winding coil and the secondary winding coil are both wounded on the winding frame 5, and induce electromagnetic interaction therebetween through the magnetic core assembly 4 so as to achieve the object of voltage regulation. The magnetic core assembly 4 is generally shaped as an EI-type core or an EE-type core. The enclosure 6 comprises a bottom plate assembly 61 and a seal plate 62. When the bottom plate assembly 61 and the seal plate 62 are assembled, the magnetic core assembly 4 and the winding frame 5 can be fixedly positioned within the inner space enclosed by the bottom plate assembly 61 and the seal plate 62, and thereby construct the body of a transformer. It is certainly that the transformer can be secured to the housing of an electric appliance or a printed circuit board (not shown) depending on requirements of circuit design.

Referring to FIG. 3 again, the winding outlets 51, 52, 53 of the primary winding coil and the secondary winding coil that are wounded around the winding frame 5 are directly led out from the winding frame 5 and optionally wrapped by an insulating film, and thereby the winding outlets 51, 52, 53 can be secured to the through holes (not shown) on the printed circuit board so that the electric connection between the transformer and the printed circuit board can be established.

Figure 4A:
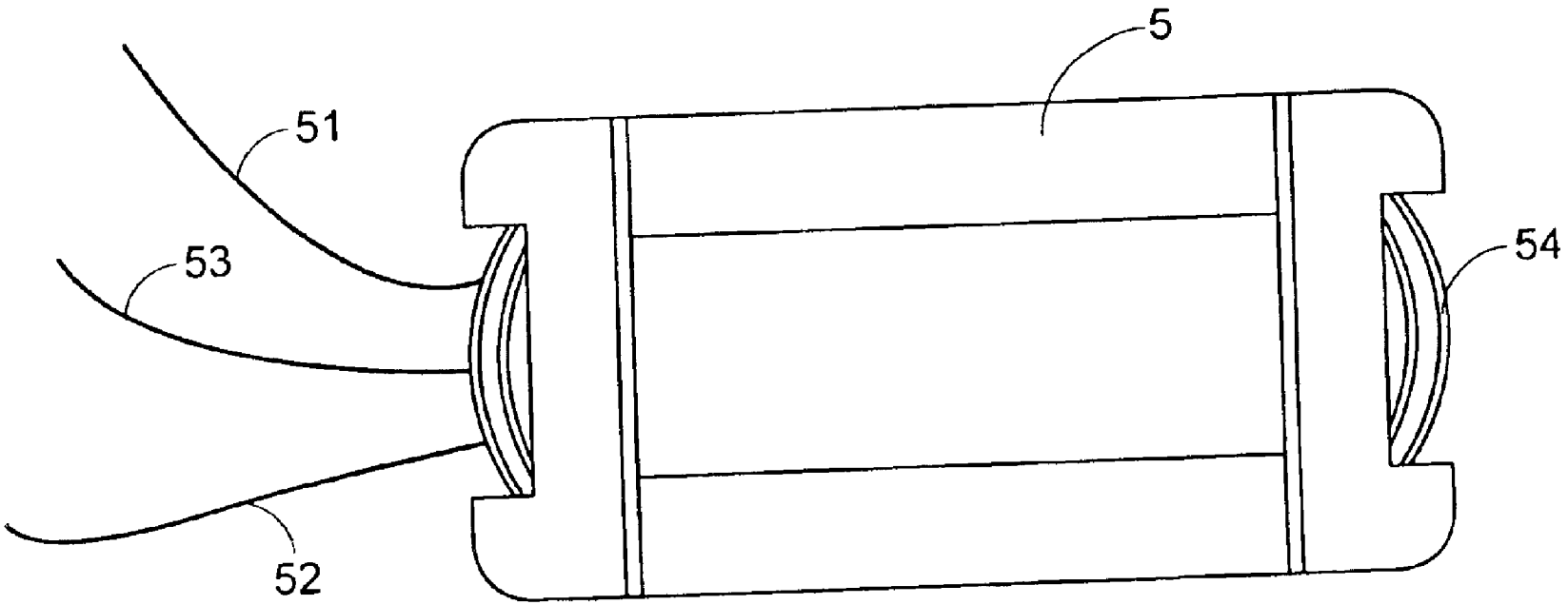
FIGS. 4(*a*)–4(*c*) are diagrams showing the steps of installing transformer winding coils and the assembling process of a transformer according to the present invention.
Figure 4B:
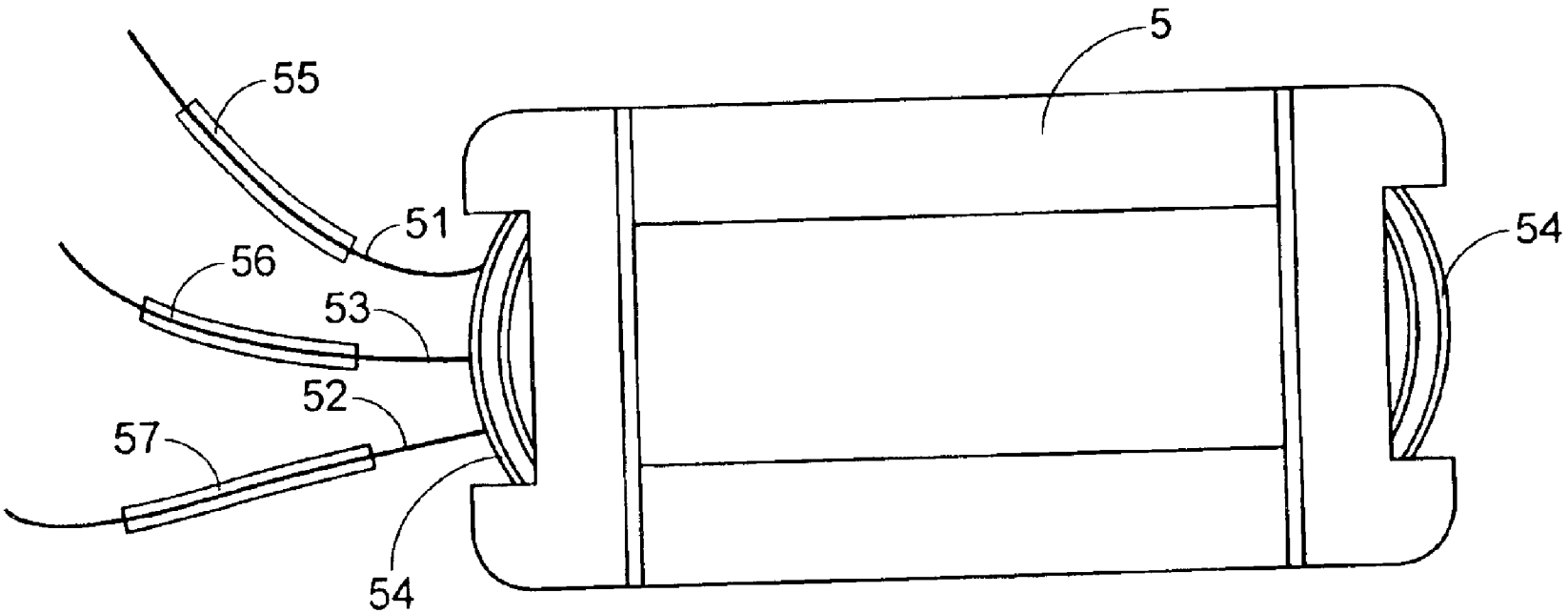
Figure 4C:
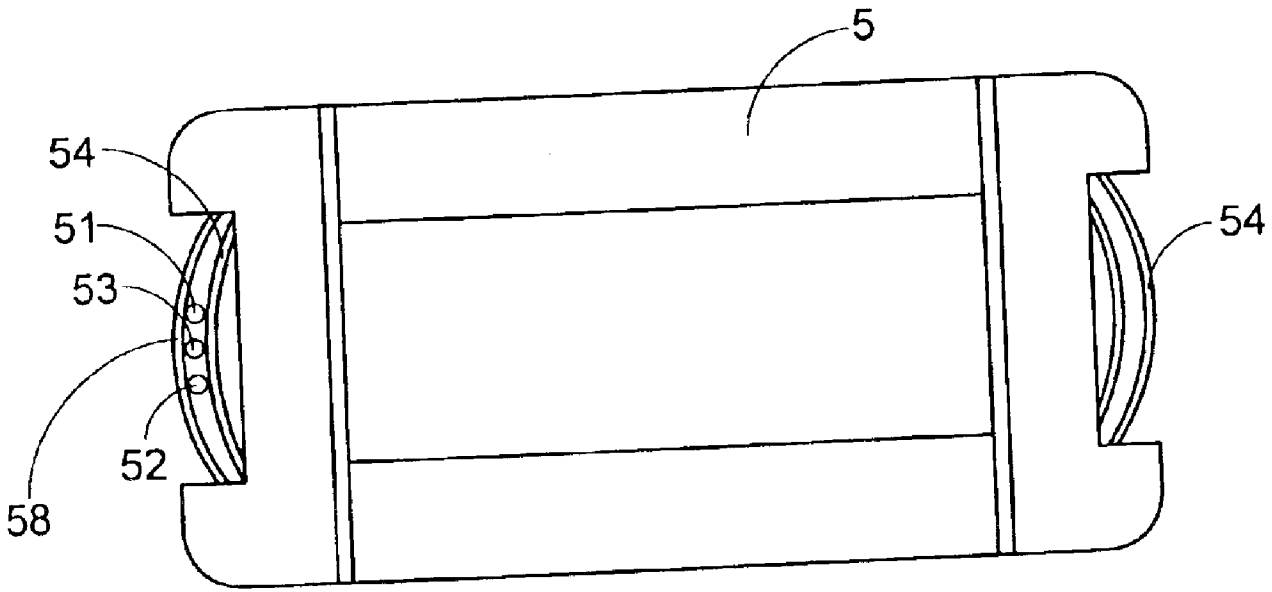

Referring to FIGS. 4(*a*) to 4(*c*), the steps of the assembling process of a transformer according to the present invention is illustrated. As shown in FIG. 4(*a*), a primary winding coil (not shown) and a secondary winding coil (not shown) are wounded around a winding frame 5, wherein the material of the transformer winding coils are preferably selected from copper wires. Next, after the transformer windings are wounded around the winding frame 5, the portions of the transformer winding that are wounded around the winding frame 5 are wrapped by tapes, and a plurality of winding outlets are led out from the winding frame 5. In this preferred embodiment, three winding outlets 51, 52, 53 are used as a preferred example to explain the method of installing transformer winding coils according to the present invention. Next, as shown in FIG. 4(*b*), each of the winding outlets 51, 52, 53 is optionally wrapped by an insulating film for the purpose of electric insulation, wherein the material of the insulating film is preferably selected from polyethylene (PE). It is well known in the art that the melting point of PE is rated at about 125° C., which indicates that the durability against temperature for the transformer can be greatly improved. More advantageously, because the transformer windings are made up of enameled copper wires, the insulating films 55, 56, 57 can be eliminated.

Next, the three copper wires (enameled copper wires) are folded upward and stuck together to the winding frame 5 with another tape 58. Next, the magnetic core assembly 4 and the winding frame 5 with transformer winding clung thereto are coupled together and positioned onto the bottom plate assembly 61. Next the seal plate 62 encloses the bottom plate assembly 61 and the supporting pins of the enclosure 6 are bent and fixed, and then the whole transformer is immersed in a petrolatum solution. After performing the baking process to the transformer, the whole manufacturing process of the transformer is completed.

Figure 5:
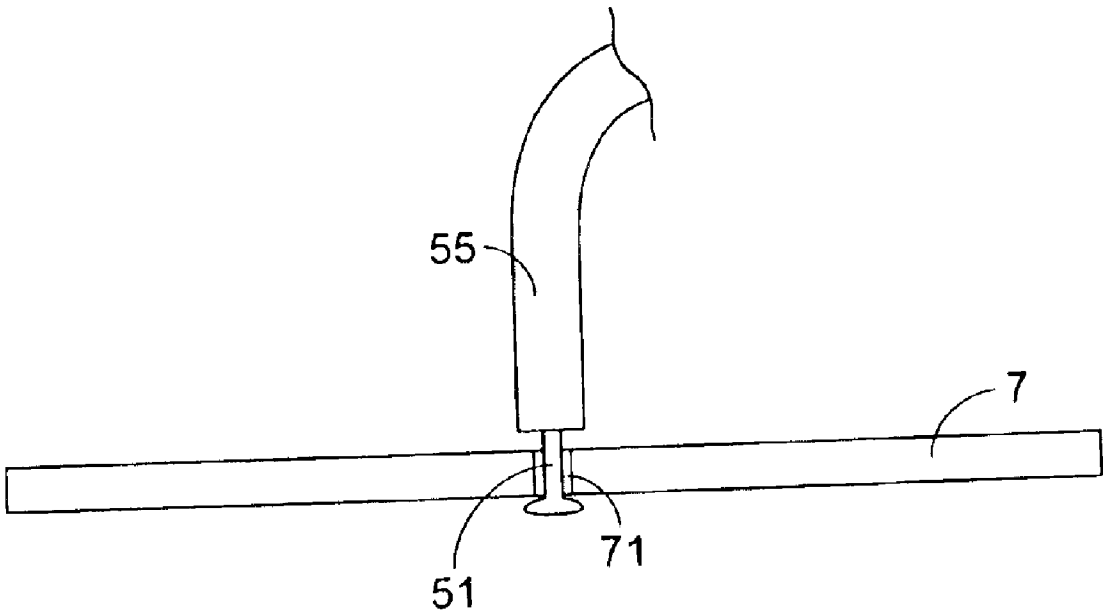
FIG. 5 is a diagram showing the winding outlets of a transformer being secured to a printed circuit board.

Referring to FIG. 5, a diagram showing the winding outlets of a transformer being secured to a printed circuit board is illustrated. According to the present invention, the transformer windings, i.e. the copper wires are directly led out from the winding frame 5 and coated with an insulating PE film. Under this condition, if it is desired to connect the outlet terminal 51 of the transformer winding to the print circuit board 7, it can be fulfilled by allowing the outlet terminal 51 of the transformer winding to penetrate the corresponding through hole 71 on the printed circuit board 7 and thus the insulating polyethylene film will withstand against the upper surface of the printed circuit board 7 at the same time. Next, the portion that have been penetrated the through hole 71 is flattened by extrusion and then processed by tin furnace, which in turn complete the operation of establishing an electric connection between the print circuit board 7 and the transformer.

In conclusion, the manufacturing technique of transformer disclosed herein is accomplishing by directly leading out winding outlets instead of soldering the winding outlets with copper wirings. Compared with the prior art, the present invention is superior to the prior art in terms of the following advantages:

1. The conventional method of installing transformer winding coils needs additional copper wirings, and thus lots of manufacturing time and costs are wasted. On the contrary, the method of installing transformer winding coils according to the present invention can directly lead out winding outlets and secure the winding outlets to a printed circuit board, which is capable of saving considerable manufacturing time and cost.

2. The conventional assembling process of transformer requires the operation of soldering the winding outlets with copper wirings, and thus it is prone to cause the problem of difficulty in soldering and the portions of the copper wires to be soldered are easy to pierce the insulating film, which in turn may cause the transformer to become short-circuited or burn out. Therefore, the manufacturing yield of transformer is degraded. However, the method of installing transformer winding coils according to the present invention is capable of directly leading out winding outlets and securing the winding outlets to a printed circuit board, which eliminates the aforesaid disadvantages while improving the manufacturing yield of transformer significantly.

3. In prior art, additional tapes and pads are necessary for the assembling of a transformer to insulate the bare portions of copper wirings from contacting with each other and protect the insulating film from being pierced and causing the transformer to become short-circuited or burn out. Hence, the conventional assembling process of transformer needs numerous additional tapes and pads, and thus the manufacturing cost is raised and the transformer structure is more complicated. In addition, because the operations of wrapping the tapes and pads need to be done iteratively, the manufacturing of transformer is difficult to carry out and the manufacturing yield of transformer is limited. The manufacturing method of transformer according to the present invention is advantageous over the prior art by saving more manufacturing cost and prompting manufacturing yield by eliminating the use of additional tapes and pads, and thereby considerable amount of manufacturing cost and time is saved.

4. The conventional transformer adopts polyvinyl chloride (PVC) as the material of the insulating film for copper wires. Because the melting point of polyvinyl chloride is lower (about 105° C.), which results in a limited durability against temperature for the transformer. The transformer of the present invention adopts polyethylene (PE) as the material of the insulating film for transformer, which widens the tolerable range of temperature for the transformer because of the higher melting point of polyethylene (about 125° C.).

While the present invention has been described in terms of what are presently considered to be the most practical and preferred embodiments, it is to be understood that the present invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A method of installing transformer winding coils, comprising the steps of:

providing a transformer including a magnetic core assembly, a winding frame, a primary winding coil, a secondary winding coil, and an enclosure, wherein the primary winding coil and the secondary winding coil are respectively wound around the winding frame;

wrapping the portions of the winding coils wound around the winding frame with a tape and leading out a plurality of winding outlets from the winding frame;

positioning the magnetic core assembly and the winding frame fixedly within the enclosure; and directly securing the plurality of winding outlets to a printed circuit board in order to electrically connect the transformer and the printed circuit board.

2. The method of installing transformer winding coils according to claim 1 wherein after the step of wrapping the portions of the winding coils wound around the winding frame with a tape and leading out a plurality of winding outlets is performed, the method further comprises a step of folding the plurality of winding outlets and wrapping the plurality of winding outlets with another tape.

3. The method of installing transformer winding coils according to claim 1 wherein the primary winding coil and the secondary winding coil are formed from copper wires.

4. The method of installing transformer winding coils according to claim 1 wherein before the step of securing the plurality of winding outlets to the printed circuit board is performed, the method further comprises a step of wrapping the plurality of winding outlets with a plurality of insulating films.

5. The method of installing transformer winding coils according to claim 4 wherein the plurality of insulating films are produced from polyethylene.

6. The method of installing transformer winding coils according to claim 1 wherein the step of directly securing the plurality of winding outlets to the printed circuit board includes steps of penetrating the plurality of winding outlets through corresponding through holes on the printed circuit board, and the portions of the plurality of winding outlets that have been penetrated the corresponding through holes are flattened by extrusion and then processed by tin furnace, and thereby directly secure to the printed circuit board.

7. A transformer structure comprising:

a winding frame;

a primary winding coil and a secondary winding coil respectively wound around the winding frame;

a magnetic core assembly interacting with the primary winding coil and the secondary winding coil wound around the winding frame in order to accomplish voltage regulation; and an enclosure that fixedly positions the magnetic core assembly and the winding frame therein;

wherein the winding frame leads out a plurality of winding outlets of the primary winding coil and the secondary winding coil and electrically secures the plurality of winding outlets to a printed circuit board directly.

8. The transformer structure according to claim 7 wherein the magnetic core assembly is shaped as an EI-type core or an EE-type core.

9. The transformer structure according to claim 7 wherein the enclosure includes a bottom plate assembly and a seal plate, and when the bottom plate assembly and the seal plate are assembled, the magnetic core assembly and the winding frame are fixed positioned within an inner space enclosed by the bottom plate assembly and the seal plate.

10. The transformer structure according to claim 7 further comprising at least one insulating film to be coated on the plurality of winging outlets for providing an electrical insulation to the plurality of winding outlets.

11. The transformer structure according to claim 7 wherein the primary winding coil and the secondary winding coil are formed from copper wires.

* * * * *